US007024732B2

(12) United States Patent
Schell

(10) Patent No.: US 7,024,732 B2
(45) Date of Patent: Apr. 11, 2006

(54) NECKTIE HOLDER

(76) Inventor: Joe P. Schell, 725 S. Nova Rd., No. 153, Ormond Beach, FL (US) 32174

( * ) Notice: Subject to any disclaimer, the term of this patent is extended or adjusted under 35 U.S.C. 154(b) by 6 days.

(21) Appl. No.: 10/773,421

(22) Filed: Feb. 9, 2004

(65) Prior Publication Data

US 2005/0172458 A1 Aug. 11, 2005

(51) Int. Cl.
*A44B 6/00* (2006.01)

(52) U.S. Cl. ..... 24/66.2

(58) Field of Classification Search ..... 24/62, 24/66.2–66.4, 66.5, 66.8, 66.11, 66.13, 56–60, 24/662, 66.6, 66.7, 49.1; 2/150, 323; D11/202–205
See application file for complete search history.

(56) References Cited

U.S. PATENT DOCUMENTS 1,422,849 A * 7/1922 Grainger ..... 24/56
1,779,868 A 10/1930 Aiken
1,784,482 A 12/1930 Crawford
1,990,720 A 2/1935 White
2,002,195 A 5/1935 Trout
2,039,022 A 4/1936 Mix
2,059,301 A * 11/1936 Albright ..... 24/66.2
2,060,040 A * 11/1936 Cobb ..... 24/66.2
2,195,594 A 4/1940 Kreisler
2,514,048 A * 7/1950 Gragg et al. ..... 24/66.11
2,592,155 A * 4/1952 Johnson ..... 24/66.2
2,606,349 A 8/1952 Albrecht
3,108,342 A * 10/1963 Schupbach ..... 24/66.13
3,319,305 A * 5/1967 Anderson ..... 24/66.11
3,968,544 A * 7/1976 Sinclair ..... 24/66.6
4,099,300 A 7/1978 Wolak
5,031,285 A * 7/1991 Wallo ..... 24/66.2
5,526,550 A 6/1996 Huang

FOREIGN PATENT DOCUMENTS

JP 3141905 6/1991

* cited by examiner

*Primary Examiner*—Jack W. Lavinder
(74) *Attorney, Agent, or Firm*—Stephen R. Greiner

(57) ABSTRACT

A necktie holder including a crossbar having opposed ends. A retainer is secured to the opposed ends of the crossbar so as to form an elongated loop together with the crossbar. The retainer is arched so that a portion of such is elevated above the crossbar. The retainer is provided with a cut along its length so as to divide the retainer into a pair of selectively separable parts. A flexible link is releasably connected to the opposed ends of the crossbar.

4 Claims, 1 Drawing Sheet

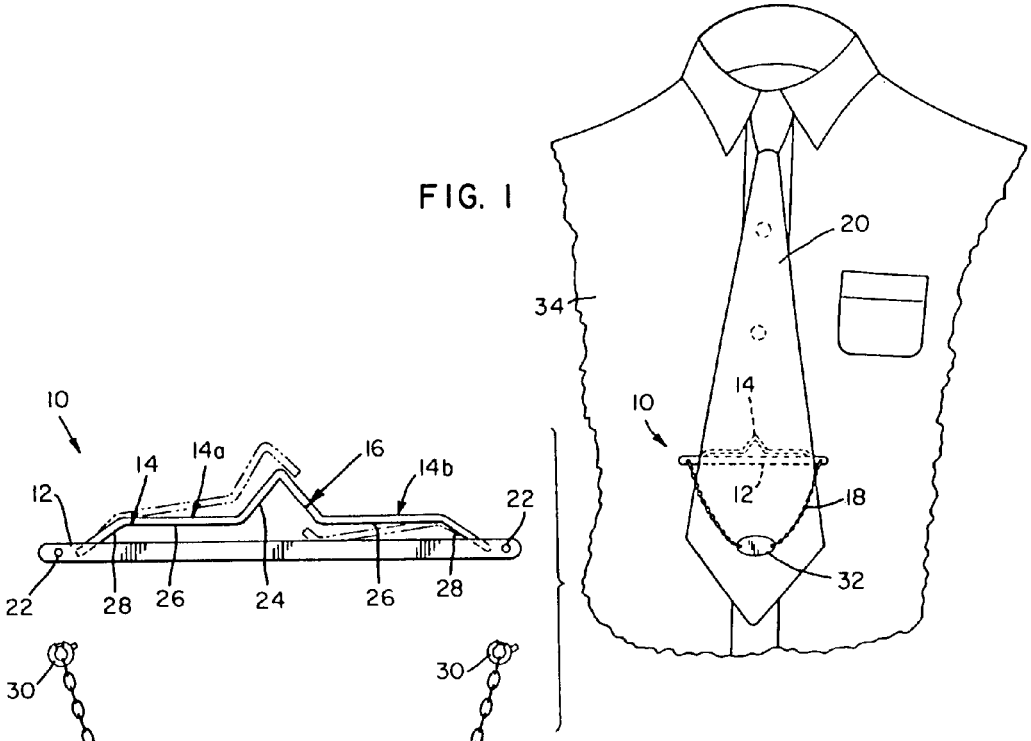
FIG. 1
FIG. 2
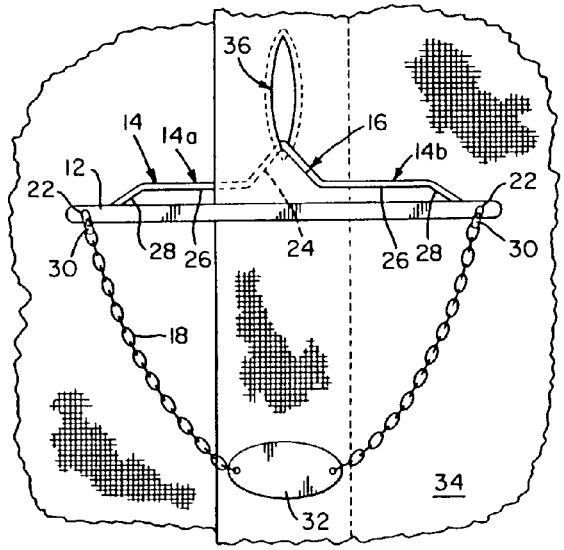
FIG. 3

NECKTIE HOLDER

FIELD OF THE INVENTION

The present invention relates generally to buckles, buttons, clasps and, more particularly, to necktie fasteners.

BACKGROUND OF THE INVENTION

Many fasteners have been proposed for holding a necktie close to the shirt of a wearer. Some of these fasteners are merely elaborate safety pins that require the penetration of the fabric of a shirt to use them. Other fasteners comprise spring clips that tend to fall off and become lost when jarred. Still others use hooks for suspension from the thread holding a button in place. Torn fabric, lost necktie fasteners, and missing buttons have discouraged many individuals who wear shirts and ties from using necktie fasteners. Furthermore, none of the known fasteners provides the wearer with the option to coordinate the appearance of the fastener with all of his apparel. A long-felt need, thus, exists for a necktie holder that places little stress on a shirt and, yet, provides the wearer the freedom to quickly and affordably select from many ornamental elements to fashionably augment his appearance.

SUMMARY OF THE INVENTION

In light of the problems associated with the known necktie fasteners, it is a principal object of the invention to provide an improved necktie holder for wear with a buttoned shirt and a conventional necktie. The necktie holder is supported from the bottom of a buttonhole (perhaps the part of a shirt with greatest reinforcement) and comfortably retains a necktie against the front of the shirt of a wearer.

It is another object of the invention to provide a necktie holder of the type described that is easy to use and capable of displaying indicia of various sorts to passersby. The user can vary the indicia to make the necktie holder into a changeable advertising system.

It is an object of the invention to provide improved elements and arrangements thereof in a necktie holder for the purposes described that is lightweight in construction, inexpensive to manufacture, and fully dependable in use.

Briefly, the necktie holder in accordance with this invention achieves the intended objects by featuring a crossbar having opposed ends. An upwardly arched retainer is secured to the opposed ends of the crossbar. The retainer has a central portion configured like an inverted "V" that is cut to permit the central portion to be selectively divided. A pair of intermediate portions is integrally formed with the central portion and extends outwardly from the bottom thereof. A pair of end portions is integrally formed with the intermediate portions and extends downwardly to the crossbar. A chain is releasably connected to the opposed ends of the crossbar.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a front elevational view of a necktie holder in accordance with the present invention shown being disposed on a shirt to prevent a necktie from swinging about.

FIG. 2 is an exploded front elevational view of the necktie holder of FIG. 1.

FIG. 3 is a front elevational view of the necktie holder shown being engaged with the buttonhole of a shirt.

Similar reference characters denote corresponding features consistently throughout the accompanying drawings.

DETAILED DESCRIPTION OF THE PREFERRED EMBODIMENT

Referring now to the FIGS., a necktie holder in accordance with the present invention is shown at 10. Necktie holder 10 includes a crossbar 12 and a retainer 14 that connects the opposed ends of crossbar 12 together so as to form an elongated loop. Retainer 14 is arched so that its midpoint is higher than its opposed ends and is provided with a cut 16 remote from either of its ends that divides such into two parts 14*a* and 14*b* of unequal length. A flexible link or chain 18 loosely connects the ends of crossbar 12 together.

Crossbar 12 has a length sufficient to span from one side of a necktie 20 to the other. The ends of crossbar 12 are provided with apertures 22. Adjacent apertures 22, the opposite ends of retainer 14 are brazed, or otherwise suitably attached, to crossbar 12.

Retainer 14 is formed of stiff wire. As shown, retainer 14 includes a central portion 24 formed like an inverted "V". A pair of intermediate portions 26 are integrally formed with central portion 24 and extend outwardly from the bottom thereof such that they are substantially parallel to crossbar 12. A pair of end portions 28 are integrally formed with the outer ends of intermediate portions 26 and extend downwardly to crossbar 12 to which such is secured. This configuration provides necktie holder 10 with a low center of gravity for great stability during use.

Cut 16 can be provided anywhere along the length of retainer 14. For ease of manufacture, however, cut 16 may best be provided in central portion 24, as shown, well away from crossbar 12. Cut 16 can be provided by application of a sharp shearing edge to retainer 14 after such is secured to crossbar 12 or in any other preferred manner.

Chain 18 carries clasps 30 at its opposite ends for releasable attachment to crossbar 12. Clasps 30 are of a well-known type and are adapted to be selectively extended through apertures 22 in crossbar 12. Obviously, clasps 30 could be carried by crossbar 12 rather than by chain 18, but should such a clasp on crossbar 12 break, holder 10 is rendered wholly unusable. Should a clasp 30 on chain 18 fail, a user need merely replace inexpensive chain 18 to continue using holder 10.

Chain 18 carries a medallion 32 at its midpoint. Medallion 32 can be provided with indicia (not shown) that identifies, by way of example only: an employer, a hobby, a cause, or the wearer himself. As will be immediately appreciated, a user can utilize holder 10 with different chains 18 and medallions 32 on different occasions with consistent elan and style. Depending on commercial availability, a user could easily add to his collection of chains 18 and medallions 32 over time. In the alternative, retailers could sell sets of chains 18 and medallions 32 as part of a system utilizing necktie holder 10.

Use of necktie holder 10 is straightforward. First, a user dons a shirt 34 and necktie 20 in a conventional manner. Next, the user deforms retainer 14 with a light force to slightly separate parts 14*a* and 14*b* from one another as illustrated by the broken line positions of FIG. 2. In this state, part 14*a* is extended through the back of a buttonhole 36 in the middle of shirt 34 so that part 14*a* projects from the front of buttonhole 36. Then, the deforming force is released to allow parts 14*a* and 14*b* to spring back together with the bottom of buttonhole 36 located within central portion 24 and lock crossbar 12 upon shirt 34 behind necktie 20. If desired, the button (not shown) associated with buttonhole 36 can be extended through buttonhole 36. Finally, chain 18 is extended across the front of necktie and clasps 30 are secured to the ends of crossbar 12 to hold necktie 20 adjacent shirt 34 as illustrated in FIG. 1.

Should a user wish to remove shirt 34 and necktie 20 and cease employing holder 10, he need merely reverse the steps outlined in the previous paragraph. After disengaging holder 10 from shirt 34, holder 10 can be conveniently stored in a glove box or drawer for subsequent use. In the event that holder 10 becomes soiled, it can be easily washed with soap and water.

It is expected that holder 10 will have a long useful life. As there is little possibility of slippage of retainer 14 down the front of shirt 34 as often occurs with clip-on fasteners, there is little possibility that holder 10 can be lost during use. Further, because parts 14*a* and 14*b* are strong and elastic, with the exercise of reasonable care by the user, installation of holder 10 on shirt 34 can be repeated many times without damage to any of its features.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A necktie holder, comprising:

a crossbar having opposed ends;

a retainer being secured to said opposed ends of said crossbar, said retainer including:

a central portion being configured as an inverted "V" and having a cut along the length thereof permitting said central portion to be selectively divided;

a pair of intermediate portions being integrally formed with said central portion and extending outwardly from the bottom; and, a pair of end portions being integrally formed with said intermediate portions and extending downwardly to said crossbar to which such engage; and, a chain being releasably connected to said opposed ends of said crossbar.

2. The necktie holder according to claim 1 further comprising a medallion being positioned at the midpoint of said chain.

3. The necktie holder according to claim 1 further comprising a pair of clasps on said chain for releasably connecting said chain to said crossbar.

4. A necktie holder, comprising:

a crossbar having opposed ends;

a wire retainer being secured to said opposed ends of said crossbar and having a cut along the length thereof permitting such to be selectively divided into two separate parts, said retainer also having:

a central portion being configured as an inverted "V" and extending above said crossbar;

a pair of intermediate portions being integrally formed with said central portion and extending outwardly from the bottom; and, a pair of end portions being integrally formed with said intermediate portions and extending downwardly to said crossbar to which such engage;

a chain being releasably connected to said opposed ends of said crossbar;

a pair of clasps being carried by said chain for releasably connecting said chain to said crossbar; and, a medallion being carried by said chain.

* * * * *